United States Patent [19]

Delaage

[11] 4,016,401

[45] Apr. 5, 1977

[54] SWITCHING DEVICE, IN PARTICULAR FOR A PRINTED CIRCUIT

[75] Inventor: Jacques Jean Delaage, Paris, France

[73] Assignee: Societe d'Etudes et de Construction de Materiel Electronique S.E.C.M.E., Paris, France

[22] Filed: Dec. 23, 1975

[21] Appl. No.: 643,798

[30] Foreign Application Priority Data

Dec. 30, 1974 France ..... 74.43292

[52] U.S. Cl. ..... 200/277; 200/DIG. 29; 200/16 C; 200/16 D

[51] Int. Cl.[2] ..... H01H 1/06

[58] Field of Search ..... 200/277, DIG. 29, 16 C, 200/16 D, 16 R

[56] References Cited

UNITED STATES PATENTS

| | | | |
|---|---|---|---|
| 2,090,544 | 5/1935 | Michel | 200/277 |
| 2,771,530 | 11/1956 | Trombetta | 200/277 |
| 3,278,715 | 10/1966 | Arbonies | 200/DIG. 29 |
| 3,643,049 | 2/1972 | Lu Conie | 200/277 |

*Primary Examiner*—Herman T. Hohauser
*Attorney, Agent, or Firm*—Oldham & Oldham Co.

[57] ABSTRACT

A grooved contact roller is movable in a housing between two switching positions determined by an elastic positioning element which defines an intermediate position in which the contact roller is in a state of unstable equilibrium. The positioning element is engaged in the groove of the roller and the latter is disposed flat against the bottom of the housing. A slidable cover for the housing constitutes an actuating member for the switch and has a journal which extends toward the bottom of the housing and is engaged with clearance in a central aperture of the roller.

7 Claims, 3 Drawing Figures

SWITCHING DEVICE, IN PARTICULAR FOR A PRINTED CIRCUIT

The present invention relates to miniature electrical switching device for use in particular on printed circuit cards.

An object of the invention is to provide a switching device which comprises a very small number of parts whose assembly is easy and may be if desired fully automatized.

According to the invention, there is provided a switching device comprising, inside a housing, at least two conductive studs which project from the bottom of the housing and are connected to outer pins, contact means movable between two positions in which it is respectively maintained by an elastically yieldable positioning element which determines in the path of the contact means a swing-over position in which position the contact means is in an unstable equilibrium, at least one of the positions of the movalbe contact means corresponding to the establishment of an electric circuit between said studs, the device further comprising an actuating means engaged with said contact means for bringing the contact means to either of its positions, wherein said contact means comprises an annular element whose outside diameter is less than the distance between said studs and which is placed flat on the bottom of the housing and said actuating means constitutes a slidable cover of the housing and has on the face thereof confronting the bottom of the housing a driving journal which engages with clearance in a centre aperture in the movable contact means.

Further features and advantages of the invention will be apparent from the ensuing description with reference to the accompanying drawing which is given merely by way of example.

Figure 1:
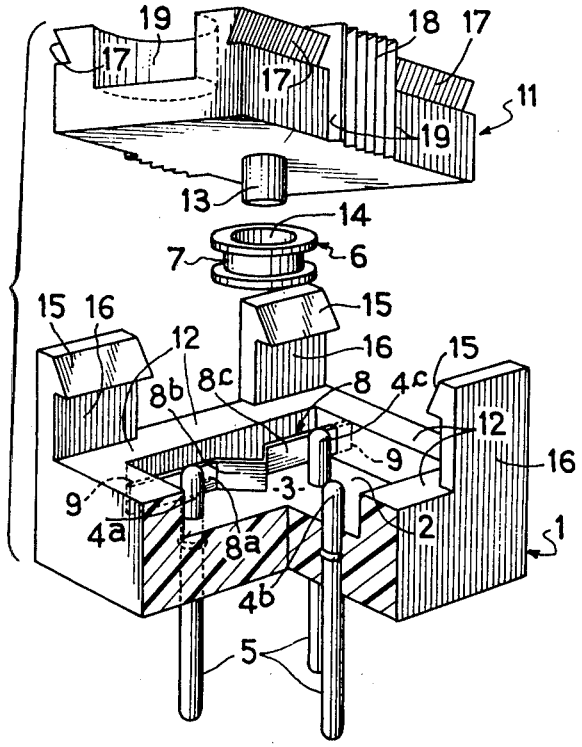
FIG. 1 is an exploded perspective view of a switching device according to the invention.

In FIG. 1, the switching device according to the invention comprises a housing 1 of an electrically insulating material obtained for example by moulding plastics material. The housing 1 has a recess 2 defining a bottom 3 from which bottom project three fixed contact studs 4*a*, 4*b*, 4*c* which extend, in the presently-described embodiment, through the bottom of the housing to outside the latter so as to form as many outer connecting pins 5. By way of example, the housing has the following approximate outside dimensions: length: 11 mm; height: 4–6 mm; width: 10 mm.

The fixed studs 4*a*, 4*b*, 4*c* cooperate with a movable contact means 6 constructed in the form of a metal roller having a peripheral groove 7. This roller is placed flat on the bottom 3 of the housing and an elastically yieldable positioning means 8 acts on the roller. This positioning means is constituted by a spring strip having two aligned end portions 8*a* and 8*c* interconnected by a V-shaped intermediate portion 8*b* whose point faces inwardly of the recess 2, it being understood that the strip is maintained on edge in two notches 9 provided in opposed walls of the recess 2, its lower edge being slightly spaced from the bottom 3.

The point of the intermediate portion 8*b* of the strip defines with the intermediate stud 4*b* a passage 10 (FIG. 2) constituting a swing-over position in which the roller 6 is in a state of unstable equilibrium when the roller 6 is shifted from one position to the other. Owing to the elastic force exerted by strip 8, the roller 6 constantly against the stud 4*b* which thus constitutes, electrically, the moving contact of a switch whose studs 4*a* and 4*c* are the fixed contacts. Note that the stud 4*a* or 4*c* may be if desired replaced by an abutment formed, for example, on one of the integral walls of the housing.

In this case the device constitutes a simple make-break switch.

In the illustrated embodiment, and depending on the position of the roller 6, the switch applies the roller against either of the fixed studs 4*a* and 4*c*, the latter being disposed at a distance d1 from each other which is less than the outside diameter d2 of the roller. In this way there is established an electric path either between the studs 4*a* and 4*b* or between the studs 4*b* and 4*c*. Note that the elastically yieldable strip 8 has a width which is slightly less than the width of the groove 7 of the roller 6 so that the V-shaped portion 8*b* of the strip can enter therein, the roller being thus guided in its movement.

An actuating means 11 forming a cover for the housing 1 is slidably mounted above the recess 3 in that it is slidable on the upper faces 12 of the walls of the housing 1.

A cylindrical spigot 13, constituting a journal, extends in a parpendicular direction from the lower face of the cover 11 into the centre aperture 14 of the roller 6 with clearance, the diameter d3 of the aperture 14 being slightly greater than the diameter d4 of the journal 14.

The cover 11 is retained on the housing 1 by a dovetail arrangement comprising four nose portions 15 formed on corresponding lugs 16 which extend in a perpendicular direction from the faces 12 at the four corners of the housing, these lugs 16 being integral with the latter. The nose portions 15 engage in complementary recesses 17 in the cover 11. The cover 11 is also provided with transverse ribs 18 which are formed on its upper face and two of its opposed lateral faces define abutments 19 limiting the travel of the cover 11 between the lugs 16. These abutments are also adapted to facilitate the positioning of the cover in either of its positions. For this purpose, the cover also has two recesses 19 on each side in which are engageable shifting means, such as a small screw-driver or other means, for shifting the cover of the switching device.

Figure 2:
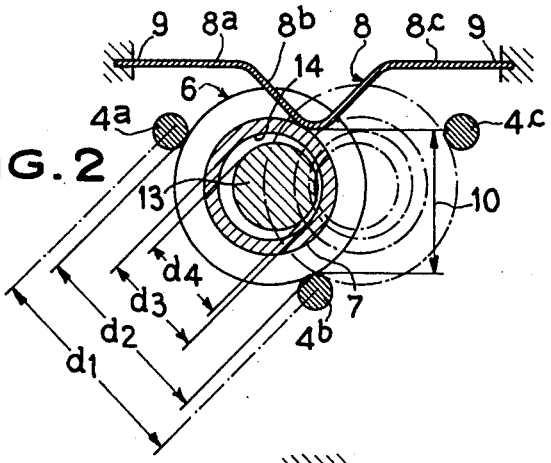
FIG. 2 is a diagrammatic plan view of the essential part of the switching device illustrating the operation of the latter.

The switching device just described operates in the following manner (FIG. 2):

With the contact means or roller 6 in one of its stable positions, for example that on the left side shown in full line in FIG. 2, it is applied against the studs 4*a* and 4*b* with roughly equal force by the action of the corresponding side of the intermediate portion 8*b* of the elastically yieldable strip 8. In this position, the journal 13 of the cover 11 is normally disengaged from the wall of the aperture 14 of the roller, it being understood that the cover can move between limits determined, on one hand, by the contact between the abutment 19 and the corresponding lug 16 and, on the other, by the contact between the journal 13 and the wall of the aperture 14. As a result of this freedom of movement, the journal 13 does not have to be positioned with precision since tolerances between the two aforementioned limits are allowable. Consequently, manufacture of the switching device is facilitated and cheaper.

To being the roller 6 to its other position, the passage 10 must be passed through, which can be achieved by an outward deformation of the elastically yieldable strip 8. Thus, the cover is slid to the right (as viewed in FIG. 2) and the journal 13 drives the roller 6 in this direction in opposition to the elastic action of the strip.

As soon as the passage 10 has been passed through, it is the strip 8 which finishes the movement, the roller being biased/to the right until it is applied against the studs 4*b* and 4*c*. Note that the roller 6 remains applied against the stud 4*b* and is rotatable on the sprigot 13 without rubbing on the stud 4*b* against which it has, on the contrary, a tendency to roll. Consequently, there is substantially negligible wear of this contact stud 4*b*.

The journal 13 of the cover is consequently subjected to stress only during the start of the travel of the roller 6 until the passage 10 has been passed through. Its diameter can therefore be reduced and the overall dimensions of the switching device may consequently also be reduced.

The device is easily assembled. The housing being fully constructed as moulded, it is sufficient to mount therein the roller 6 and the strip 8 after which the cover may be placed in position by an elastic clipping thereof between the lugs 16. These operations may be carried out automatically on a special machine.

The movable contact mean 6 may be, if desired, constituted by a ring which has no groove or a smooth periphery, the elastically yieldable strip bearing in this case against this periphery. It is then advantageous that the ring be guided between the bottom 3 and the lower face of the cover 11.

Figure 3:
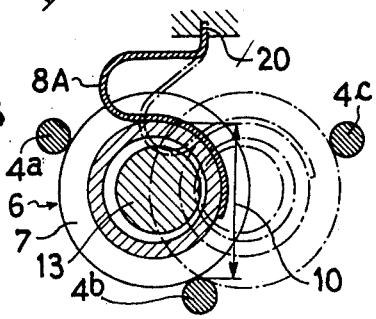
FIG. 3 is a plan view of a modification of the invention.

FIG. 3 shows a modification of the switching device according to the invention in which the elastically yieldable means 8A has a shape approximately in the form of an S and is retained at one end in a notch 20 in the wall of the housing opposite the stud 4*b*, and which conforms, at its other end, to a part of the circumference constituted by the bottom of the groove 7 of the roller 6. This embodiment operates in a manner similar to that of the embodiment described with reference to FIG. 2.

Having now described my invention what I claim as new and desire to secure by Letters Patent is:

1. A switching device comprising a housing having a bottom, at least two electrically conductive studs projecting from the bottom of the housing and connected to connection members outside the housing, an annular contact means having an outside diameter exceeding the distance between said studs and movable in a path between two positions, as elastically yieldable positioning element cooperative with the contact means for maintaining the contact means in each of said positions and defining in said path a position through which a state of unstable equilibrium is passed through by the contact means, at least one of the two positions of said contact means corresponding to the establishment of an electric circuit between said studs, actuating means combined with said contact means for bringing the contact means to a selected one of said two positions, said contact means comprising a roller having a centre aperture and a peripheral groove in which groove there is engaged the elastically yieldable element, the roller being placed flat on the bottom of the housing, the actuating means constituting a cover for the housing which cover is slidable relative to the housing and has a face confronting the bottom of the housing and a driving journal extending from said face and engaged with clearance in a centre aperture in the roller.

2. A device as claimed in claim 1, comprising four guide lugs which extend in a perpendicular direction from a top face of the housing at four corners of the housing, elastically yieldable clipping means interposed between the cover and the housing retaining the cover on the housing.

3. A device as claimed in claim 2, comprising lateral projecting portions on the cover which limit the travel of the cover by abutment against the guide lugs.

4. A device as claimed in claim 3, wherein the projecting portions are formed by ribs which extend on an upper face of the cover so as to facilitate the shifting of the cover.

5. A device as claimed in claim 2, wherein the elastically yieldable clipping means comprise a dovetail arrangement provided respectively on the cover and housing.

6. A device as claimed in claim 1, wherein the housing has opposed walls and the elastically yieldable element comprises a spring strip mounted on edge in the housing and having two end portions by which end portions it is maintained in the two opposed walls of the housing and an intermediate V-shaped portion which faces inwardly of the housing and is engaged in the bottom of the groove of the roller.

7. A device as claimed in claim 1, wherein the housing has a wall and the elastically yieldable element comprises a spring strip which has substantially the shape of an S and has a first end portion by which end portion it is secured in an notch in said wall of the housing, the spring strip having a second end portion which conforms to the shape of a part of a circumferential surface of the roller.

* * * * *

UNITED STATES PATENT OFFICE

CERTIFICATE OF CORRECTION

Patent No. 4,016,401 Dated April 5, 1977

Inventor(s) Jacques Jean Delaage

It is certified that error appears in the above-identified patent and that said Letters Patent are hereby corrected as shown below:

Column 1, line 21, change "movalbe" to --movable--

Column 2, line 7, after "stantly", insert --bears--

Column 3, line 3, change "being" to --bring--

Column 3, line 11, remove the slash mark "/"

Column 3, line 13, change "sprigot" to -- spigot --.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*